US011219294B2

(12) United States Patent
Chaillet-Piquand et al.

(10) Patent No.: US 11,219,294 B2
(45) Date of Patent: Jan. 11, 2022

(54) COSMETIC APPLICATOR

(71) Applicant: L'Oreal, Paris (FR)

(72) Inventors: Noémie Chaillet-Piquand, Paris (FR); William Bickford, Clark, NJ (US)

(73) Assignee: L'Oreal, Paris (FR)

( * ) Notice: Subject to any disclaimer, the term of this patent is extended or adjusted under 35 U.S.C. 154(b) by 327 days.

(21) Appl. No.: 15/908,224

(22) Filed: Feb. 28, 2018

(65) Prior Publication Data

US 2019/0261762 A1 Aug. 29, 2019

(51) Int. Cl.

| | |
|---|---|
| ***A45D 40/26*** | (2006.01) |
| ***A45D 37/00*** | (2006.01) |
| ***A45D 33/34*** | (2006.01) |
| ***A45D 40/28*** | (2006.01) |

(52) U.S. Cl.

CPC ..... *A45D 37/00* (2013.01); *A45D 33/34* (2013.01); *A45D 40/28* (2013.01); *A45D 2200/1018* (2013.01); *A45D 2200/1027* (2013.01)

(58) Field of Classification Search

CPC ..... A45D 33/34; A45D 37/00; A45D 40/28; A45D 2200/1018; A45D 2200/1027; A45D 2200/10; A45D 2200/1009

See application file for complete search history.

(56) References Cited

U.S. PATENT DOCUMENTS 1,565,775 A * 12/1925 Bash ..... A45D 33/34 15/229.14
6,601,591 B1 * 8/2003 Carullo ..... A45D 40/00 132/320
2006/0065282 A1 * 3/2006 Hartstock ..... A45D 34/042 132/320
2009/0036807 A1 2/2009 Habatjou
2012/0298131 A1 11/2012 Polanish
2013/0198989 A1 8/2013 Jemsby et al.

FOREIGN PATENT DOCUMENTS

| | | | |
|---|---|---|---|
| FR | 2985892 A1 | | 7/2013 |
| JP | H11221116 A | | 8/1999 |
| WO | WO 2005/115195 | * | 5/2005 |
| WO | 2017/053492 A1 | | 3/2017 |

OTHER PUBLICATIONS

International Search Report, Application No. PCT/US2019/015861, dated May 15, 2019, 14 pages.

Notification Concerning Transmittal of International Preliminary Report on Patentability for corresponding International Application No. PCT/US2019/015861, dated Sep. 1, 2020, 8 pages.

* cited by examiner

*Primary Examiner* — Rachel R Steitz

(74) *Attorney, Agent, or Firm* — Christensen O'Connor Johnson Kindness PLLC

(57) ABSTRACT

An applicator of topical formulas. The applicator includes a monolithic piece of material having two equally sized major surfaces separated by a thickness of the material, wherein each major surface has a convex surface section at a maximum that transitions to concave surfaces toward the periphery or diminishes toward the periphery, and the piece of material has a perimeter shape defined by the following: a first plane of symmetry bisecting both major surfaces into two similar halves; each half has a turning point maximum through which a second plane further divides each half into two approximate quadrants; a first approximate quadrant of each half has a concave periphery; and a second approximate quadrant of each half has a convex periphery.

20 Claims, 8 Drawing Sheets

COSMETIC APPLICATOR

SUMMARY

In an embodiment, an applicator of topical formulas comprises a monolithic piece of material having two equally sized major surfaces separated by a thickness of the material, wherein each major surface has a convex surface section at a maximum that transitions to concave surfaces toward the periphery or diminishes toward the periphery, and the piece of material has a perimeter shape defined by the following: a first plane of symmetry bisecting both major surfaces into two similar halves; each half has a turning point at a maximum through which a second plane further divides each half into two approximate quadrants; a first approximate quadrant of each half has a concave periphery; and a second approximate quadrant of each half has a convex periphery.

In an embodiment, the piece of material is 100% by weight thermoplastic urethane and unavoidable impurities.

In an embodiment, a shape in a thickness direction at an entire edge of the periphery from one major surface to the other is approximately parabolic.

In an embodiment, a shape in a thickness direction at an entire edge of the periphery from one major surface to the other is approximately a point.

In an embodiment, the piece of material has a durometer of 55 Shore A to 80 Shore A.

In an embodiment, a majority of the periphery of the first approximate quadrant of each half is concave.

In an embodiment, a majority of the periphery of the second approximate quadrant of each half is convex.

In an embodiment, the concave and the convex periphery have a similar radius.

In an embodiment, the concave edge and the convex periphery have a dissimilar radius.

In an embodiment, the thickness of the piece of material decreases from a convex section to the periphery.

In an embodiment, when the applicator is arranged in a three-axis coordinate system, wherein the applicator is bisected in two axes into mirror images.

In an embodiment, when the applicator is arranged in a three-axis coordinate system, the applicator has two opposite convex turning points in two axes.

In an embodiment, a radius of a convex turning point is larger than a radius of the opposite convex turning point in a first axis.

In an embodiment, a radius of a convex turning point is the same as a radius of the opposite convex turning point in a second axis.

In an embodiment, the major surfaces are arranged with a length and width in the first and second axes.

In an embodiment, the thickness is in the third axis.

In an embodiment, a maximum in a third axis is placed more toward the convex turning point having the larger radius compared to the opposite convex turning point in the first axis.

In an embodiment, the maximum in the third axis is placed in the center between the convex turning point and the opposite convex turning point having the same radius in the second axis.

In an embodiment, the maximum in the third axis includes a convex surface section in the major surfaces.

In an embodiment, a combination comprises an application and a formula configured for topical application on the skin, wherein the applicator is a monolithic piece of material having two equally sized major surfaces separated by a thickness of the material, wherein each major surface has a convex surface section that transitions to concave surfaces toward the periphery, and the piece of material has a perimeter shape defined by the following: a first plane of symmetry bisecting both major surfaces into two similar halves; each half has a turning point at a maximum through which a second plane further divides each half into two approximate quadrants; a first approximate quadrant of each half has a concave periphery; and a second approximate quadrant of each half has a convex periphery.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
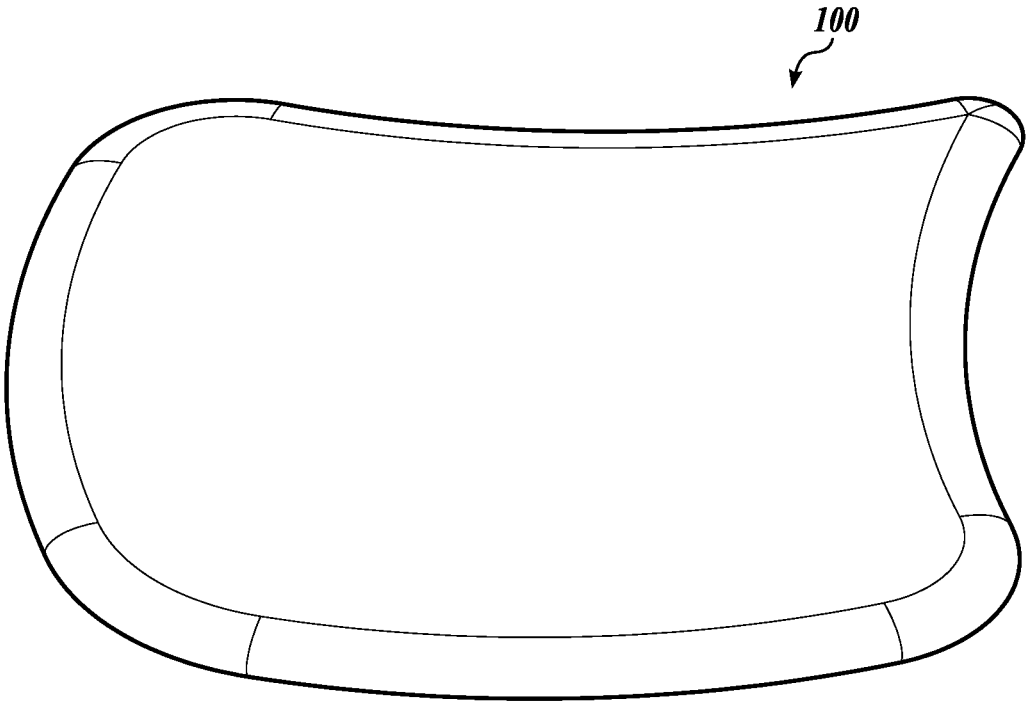
FIG. 1 is a perspective view of a first embodiment of an applicator.

Embodiments of an applicator for topical formulations include convex and concave edges and surfaces. The applicator is made from a flexible material and has a plurality of application surfaces designed to apply a fluid formula. In an embodiment, the applicator is designed for applying thick, viscous and quick drying formulas to areas on the skin, for example. Topically applied formulas include, but, are not limited to skin tightening, anti-wrinkle, or anti-aging formulas to prevent or correct areas of the skin suffering from natural signs of aging, such as crow's feet, bags under eyes, glabellar lines, and wrinkles around the mouth and nose.

Embodiment of the applicator having concave and convex surfaces is used for applying a thick formula evenly onto precise areas on the face, neck, or other areas of skin. In an embodiment, the formula has a quick drying time and so should be applied quickly in as few wipes/passes over the skin as possible and with minimal or no reapplication. In an embodiment, the applicator is flexible to compliment the contours and surfaces of the skin that it passes over. In an embodiment, the material of construction for the applicator is resistant to any formulas having high amounts of volatiles or solvent like characteristics.

In an embodiment, the applicator with convex and concave surfaces is made from a thermoplastic urethane (TPU) or thermoplastic elastomers (TPE). In an embodiment, TPU is preferred for its chemical resistance against topical formulas containing high amounts of volatiles. However, for use with less aggressive topical formulas, other elastomers and even silicones are suitable. In one embodiment of the applicator, the applicator is injection molded. However, other molding processes are also suitable. In one embodiment, applicators are molded in white or natural as well as colored to hide color cosmetic stains, such as from foundation or concealers. In an embodiment of the applicator, the surface has a slight texture resembling a faint matte texture. The surface texturing provides a precise and subtle amount of adhesion for the formula as it is distributed across the skin.

Thermo Plastic Urethanes are commercially available in various durometers. In one embodiment, the material of the applicators has a durometer from 55 Shore A to 80 Shore A hardness. In an embodiment, the material has a durometer of 59 Shore A to 65 Shore A. In an embodiment, the material has a durometer of 55 Shore A to 65 Shore A. In an embodiment, the material has a durometer of 55 Shore A.

In an embodiment, the applicator having concave and convex surfaces has particularly defined curved edges on specific areas, as further described herein. In an embodiment, the size of the applicator is particularly suited to fit a person's hand. In an embodiment, the applicator includes flexible, thin "wiper" edges to allow an evenly distributed application of the formula in any area on the face or skin. In an embodiment, any rough, uneven, or molding features, such as flashing and gate marks, are removed from the edges to create a continuous application perimeter around the applicator to ensure a clean and repeatable application.

FIGS. 1-7 are diagrammatical illustrations of one embodiment of an applicator 100 for topical formulas.

The FIGS. 1-7 show an applicator 100 as a monolithic piece of material having two similarly sized major surfaces 102, 104 separated by a thickness of the material. The thickness of the applicator 100 varies with location on the major surfaces 102, 104. The piece of material is particularly shaped to be used as a hand held applicator for topically applied formulas.

Figure 2:
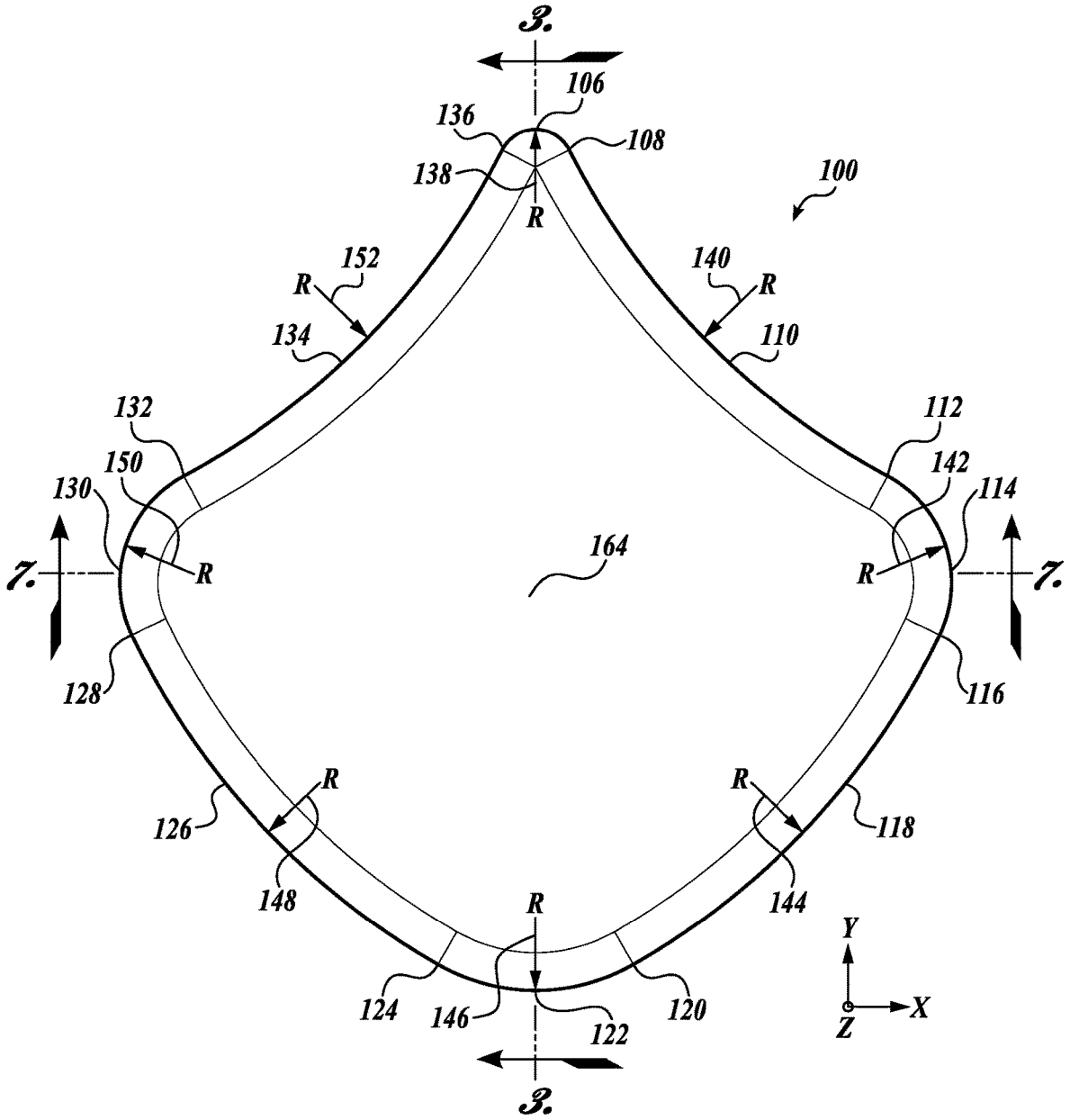
FIG. 2 is a front view of the applicator of FIG. 1, the back view being a mirror image thereof.
Figure 3:
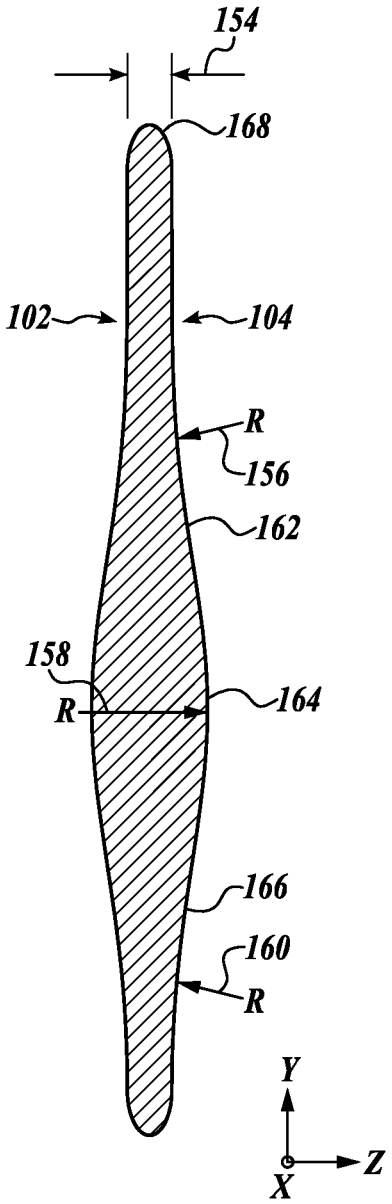
FIG. 3 is a cross-sectional view of the applicator of FIG. 1.

FIG. 2 shows one of the major surfaces 102, the opposite surface 104 being similar. The major surface 102 is defined by a periphery. The major surface 102 of the applicator 100 can be bisected by a plane of symmetry (the zy-plane) that divides the major surface 102 into two similar halves. The zy-plane of symmetry crosses the periphery of the applicator 100 at a first and second turning point 106, 122, both are local convex maximums. FIG. 3 shows the cross section of the applicator 100 of the zy-plane of symmetry showing the opposite major sides 102 and 104 being separated by the thickness dimension.

In an embodiment, the radius 138 of the first convex turning point 106 is smaller than the radius 146 of the second convex turning point 122. The applicator 100 has a periphery that is advantageous for applying topical formulations.

FIG. 2 is best used in describing the periphery of the mirror images of the major surfaces 102, 104 created by bisecting along the zy-plane of symmetry. Beginning at the first convex turning point 106 and moving clockwise, the periphery has an inflection point at 108 where convexity gives way to concavity. Convex is defined as a bulge in the periphery of the applicator 100 and concave is defined as an indentation in the periphery of the applicator 100. Another more specific definition of convex is a curve in the periphery that is defined by a radius that lies wholly or partly on the inside of the piece of material. For large radiuses of convex sections, the radius can pass both inside and outside the applicator 100. A radius for a concave section lies outside of the piece of material.

From the inflection point 108, the periphery is concave to a second point of inflection at 112. From the point of inflection 112 to the turning point 122, the periphery is convex starting with a relatively smaller radius 142 from the point of inflection 112 increasing to a larger radius 144. The location where the smaller radius 142 meets the larger radius 144 is the intersection point 116. Then, from the intersection point 116, the periphery maintains the larger radius 144 and changes again at the intersection point 120 from the larger radius 144 to the smaller convex radius 146 of the turning point 122. The convex section defined by radius 142 also has a turning point at 114 defining a local maximum.

The other half bisected by the zy-plane of symmetry is similar. Again, for the second half and beginning at the first convex turning point 106 and moving counterclockwise, the periphery has an inflection point at 136. From the inflection point 136, the periphery is concave with a radius 152 to the point of inflection 132. From the point of inflection 132 to the turning point 122, the periphery is convex starting with a relatively smaller radius 150 from the point of inflection 132 increasing to a larger radius 148 at the intersection point 128. The periphery maintains radius 148 to intersection point 124 where the larger radius 148 changes to the smaller convex radius 146 of the turning point 122. The convex section defined by radius 150 also has a turning point at 130 defining a local maximum.

If, in addition to the bisection of the applicator 100 in the zy-plane of symmetry, an xz-plane bisects the applicator 100 from the turning point 114 to the turning point 130, the major surface halves are further divided into approximate quadrants, wherein a first approximate quadrant of each major surface half has a concave edge 110 and 134 of similar radius 140 and 152, respectively, for the majority of the approximate quadrant. A second approximate quadrant of each major surface half has a convex edge 118 and 126 of similar radius 144 and 148, respectively, for the majority of the approximate quadrant. That is, the majority of the periphery of the first approximate quadrant of each half is concave, and the majority of the periphery of the second approximate quadrant of each half is convex. In an embodiment, the radius of the concave edge of the first approximate quadrant is the same as the radius of the convex edge of the second approximate quadrant for each half.

The applicator 100 has four turning points 106, 114, 122, 130 or local maximums that approximately define the corners of a square. That is, the applicator 100 can almost be arranged into an approximate square where each of the turning points approximately touches a side of the square. The applicator 100 only approximates a square, because one side of the piece of material can be slightly longer than the other.

Figure 4:
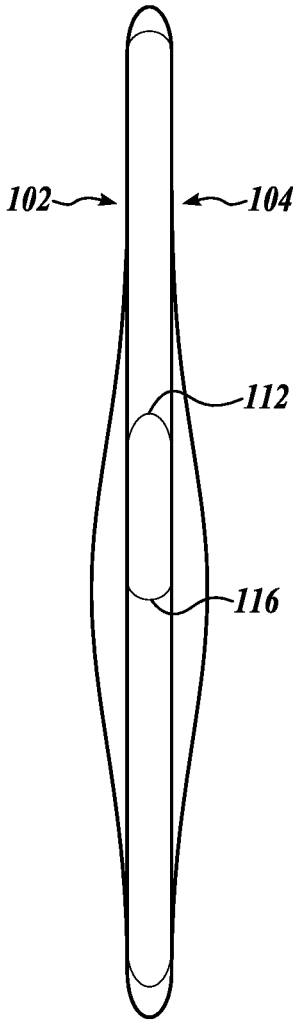
FIG. 4 is a left view of the applicator of FIG. 1, the right view being a mirror image thereof.

FIGS. 3 and 4 show the surface contours of the major surfaces 102 and 104 along the y-axis direction of applicator 100. It can be seen that the applicator 100 not only has concave and convex shapes around the periphery, but both of the major surfaces 102 and 104 themselves have concave and convex shapes. In the case of the two major surfaces 102 and 104, the convex and concave shapes define three-dimensional surfaces.

FIG. 3 is the zy-plane of symmetry viewed from the x-axis, i.e., the cross-sectional view of the applicator 100 cut along the zy-plane crossing turning points 106 and 122. A second plane of symmetry, the yx-plane bisects the applicator 100 down the thickness into two similar halves, one including the entirety of major surface 102 and the second including the entirety of major surface 104. It can be seen that the first and second major surfaces 102 and 104 are mirror images of each other. Referring to FIG. 3, the thickest part of the applicator 100 approximately coincides with a line crossing the periphery at the intersection points 116 and 128 (FIG. 2). The line that crosses the periphery at the opposite intersection points 116 and 128 divides the applicator 100 into two asymmetrical halves. From FIG. 2, one asymmetrical half includes both approximate quadrants of the periphery having majority concave sections. The other asymmetrical half includes both approximate quadrants of the periphery having majority convex sections.

In an embodiment, the centroid (used herein to quickly denote the z-direction maximum, which may not coincide with center of mass or gravity) lies on such line between the turning points 114 and 130. However, the centroid and line are offset from the true middle distance between turning points 106 and 122, and are placed more toward the turning point 112 than the turning point 106. This location balances the applicator for the user and keeps the thumb and forefinger away from the eye area.

The applicator 100 when viewed on edge defines a thickness of material that is greatest at the centroid (z-axis maximum 164) and the thickness decreases toward the periphery in all directions from the centroid. Each major surface 102 and 104 at the thickest part has a dome or convex surface section 164 of similar radius 158. However, the thickest part of the dome or convex surface section 164 does not lie at the center in the y-axis direction.

Referring to FIG. 3, major surface 104 has a concave surface section 162 adjoining the convex surface section 164 in the asymmetrical half where the concave peripheries 110, 134 are seen in FIG. 2. Major surface 104 has a concave surface section 166 adjoining the convex surface section 164 in the asymmetrical half where the convex peripheries 118, 126 are seen in FIG. 2. In an embodiment, the concave radius 156 of major surface 104 is about twice the concave radius 166. Concave surface sections 162, 166 may flatten out to a radius of infinity when approaching the periphery. Thus, the general shape of major surface 104 in the y-axis direction is a convex surface section 164 located offset from the true center which then transitions to concave sections when extending outward from the convex section 164 to the periphery. The major surface 102 is similar to major surface 104 in the y-axis direction as just described.

A further feature of the applicator of FIGS. 1-7 is the cross sectional shape at the periphery. From FIG. 3, the cross-sectional shape at the periphery has a "bullet" edge. The bullet edge 168 is an edge that tapers to an approximate parabolic edge (e.g. resembles half of an ellipse in cross-section). The bullet edge transitions tangentially into each of the respective major surfaces 102, 104 on each side of the applicator 100. The domed surface plus the bullet edge gives a "buttress effect" that gives the right gradient of flexibility to the applicator edge in conjunction with the durometer of the thermoplastic urethane polymer.

Figure 5:
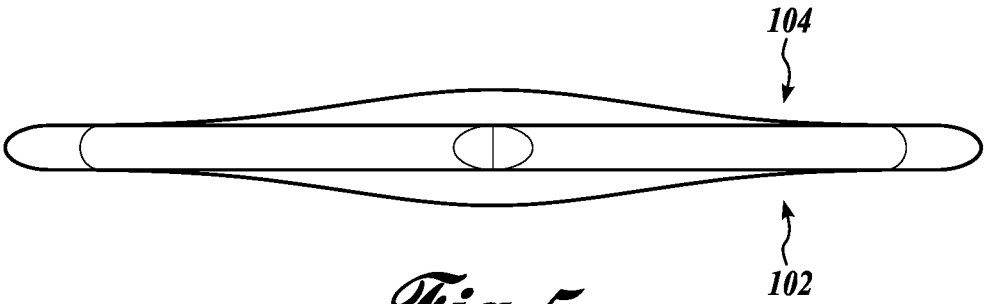
FIG. 5 is a top view of the applicator of FIG. 1.
Figure 6:
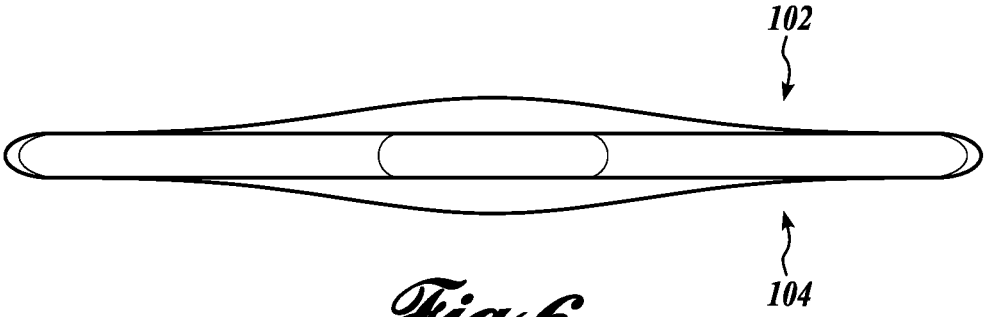
FIG. 6 is a bottom view of the applicator of FIG. 1.
Figure 7:
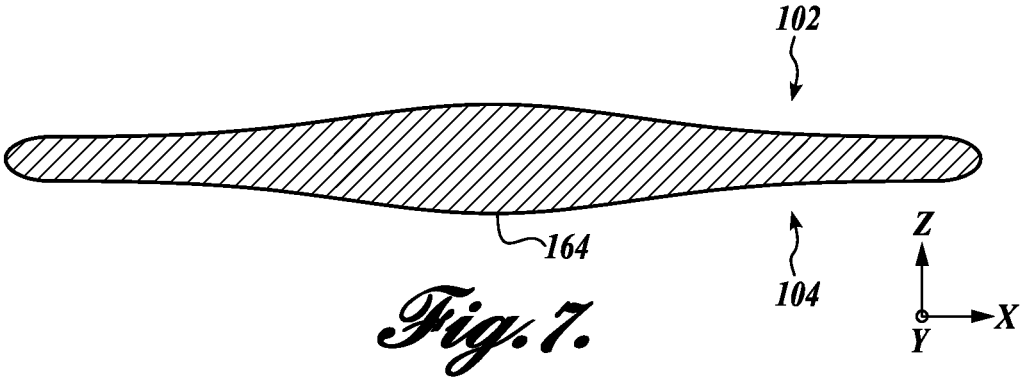
FIG. 7 is a cross sectional view of the applicator of FIG. 1
Figure 8:
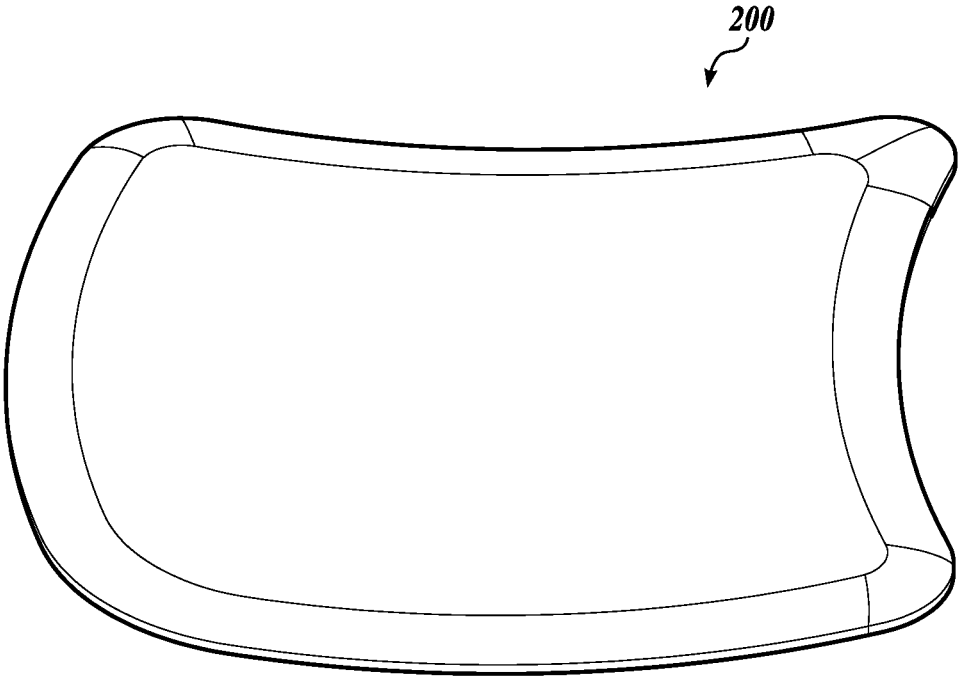
FIG. 8 is a perspective view of a second embodiment of an applicator.

FIGS. 5, 6, and 7 show the surface contours of the major surfaces 102 and 104 along the x-axis direction. FIGS. 5, 6, and 7 show the applicator 100 along the y-axis direction from the top, bottom and cross section. The general shape of major surface 104 in the x-axis direction is a gradually decreasing thickness when extending outward from the true center in either x-axis direction to the periphery. Thus, the maximum of the dome or convex surface 164 does not lie in the true center of the applicator 100 in the y-axis direction, but, does lie in the center of the applicator 100 in the x-axis direction.

FIG. 7 is the zx-plane viewed from the y-axis, i.e., the cross-sectional view of the applicator 100 cut along the zx-plane crossing turning points 114 and 130. From FIG. 7, the applicator can be bisected along the yx-plane of symmetry into the two major surfaces 102 and 104. This shows that the major surfaces 102 and 104 are mirror images along the x-axis direction as along the y-axis direction as described in FIG. 3.

Referring to FIG. 7, along the x-axis, the convex surface sections of both major surfaces 102, 104 have their maximum at the center of the applicator 100. Along the x-axis direction when moving away from the center in both directions, the convex surface section 164 of both major surfaces 102, 104 transitions into concave surface sections, and the concave surface sections then become flat and end in a bullet edge at the periphery.

FIGS. 8-14 are diagrammatical illustrations of one embodiment of an applicator 200 for topical formulas.

The FIGS. 8-14 show an applicator 200 as a monolithic piece of material having two similarly sized major surfaces 202, 204 separated by a thickness of the material. The thickness of the applicator 200 varies with location on the major surfaces 202, 204. The piece of material is particularly shaped to be used as a hand held applicator for topically applied formulas.

Figure 9:
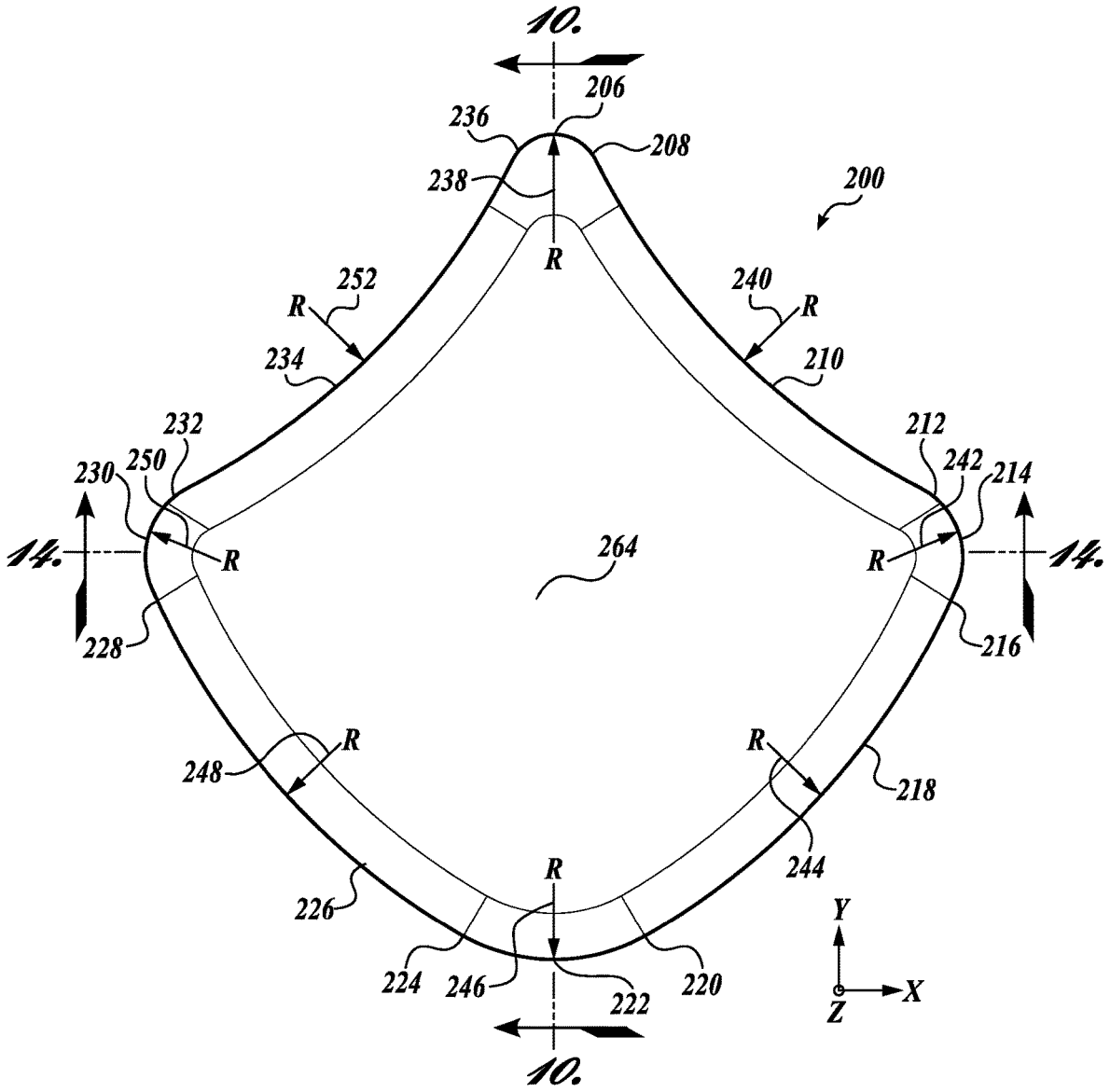
FIG. 9 is a front view of the applicator of FIG. 8, the back view being a mirror image thereof.
Figure 10:
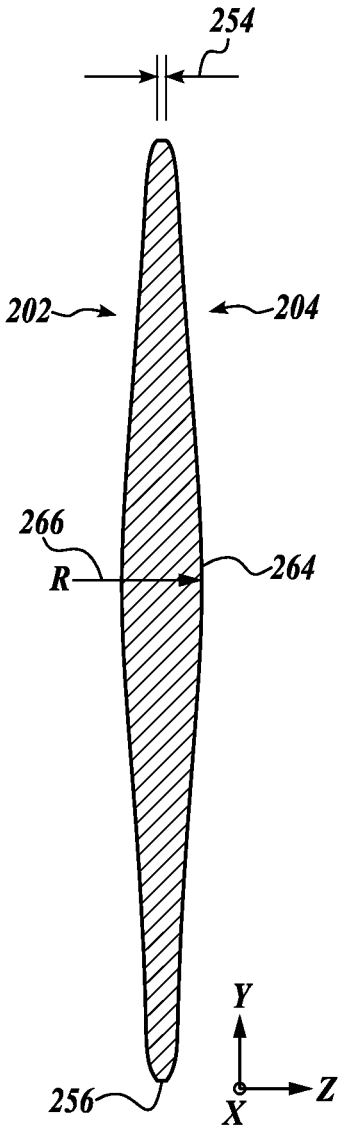
FIG. 10 is a cross-sectional view of the applicator of FIG. 8.

FIG. 9 shows one of the major surfaces 202, the opposite surface 204 being similar. The major surface 202 is defined by a periphery. The major surface 202 of the applicator 200 can be bisected by a plane of symmetry (the zy-plane) that divides the applicator 200 into two similar halves. The zy-plane of symmetry crosses the periphery of the applicator 200 at a first and second turning point 206, 222, both are local convex maximums. FIG. 10 shows the cross section of the applicator 200 of the zy-plane of symmetry showing the opposite major sides 202 and 204 being separated by the thickness dimension.

In an embodiment, the radius 238 of the first convex turning point 206 is smaller than the radius 246 of the second convex turning point 222. The applicator 200 has a periphery that is advantageous for applying topical formulations.

FIG. 9 is best used in describing the periphery of the mirror images of the major surfaces 202, 204 created by bisecting along the zy-plane of symmetry. Beginning at the first convex turning point 206 and moving clockwise, the periphery has an inflection point at 208 where convexity gives way to concavity. Convex is defined as a bulge in the periphery of the applicator 200 and concave is defined as an indentation in the periphery of the applicator 200. Another more specific definition of convex is a curve in the periphery that is defined by a radius that lies wholly or partly on the inside of the piece of material. For large radiuses of convex sections, the radius can pass both inside and outside the applicator 200. A radius for a concave section lies outside of the piece of material.

From the inflection point 208, the periphery is concave to a second point of inflection at 212. From the point of inflection 212 to the turning point 222, the periphery is convex starting with a relatively smaller radius 242 from the point of inflection 212 increasing to a larger radius 244. The location where the smaller radius 242 meets the larger radius 244 is the intersection point 216. Then, from the intersection point 216, the periphery maintains the larger radius 244 and changes again at the intersection point 220 from the larger radius 244 to the smaller convex radius 246 of the turning point 222. The convex section defined by radius 242 also has a turning point at 214 defining a local maximum.

The other half bisected by the zy-plane of symmetry is similar. Again, for the second half and beginning at the first convex turning point 206 and moving counterclockwise, the periphery has an inflection point at 236. From the inflection point 236, the periphery is concave with a radius 252 to the point of inflection 232. From the point of inflection 232 to the turning point 222, the periphery is convex starting with a relatively smaller radius 250 from the point of inflection 232 increasing to a larger radius 248 at the intersection point 228. The periphery maintains radius 248 to intersection point 224 where the larger radius 248 changes to the smaller convex radius 246 of the turning point 222. The convex section defined by radius 250 also has a turning point at 230 defining a local maximum.

If, in addition to the bisection of the applicator 200 in the zy-plane of symmetry, an xz-plane bisects the applicator 200 from the turning point 214 to the turning point 230, the major surface halves are divided into approximate quadrants, wherein a first approximate quadrant of each major surface half has a concave edge 210 and 234 of similar radius 240 and 252, respectively, for the majority of the approximate quadrant. A second approximate quadrant of each major surface half has a convex edge 218 and 226 of similar radius 244 and 248, respectively, for the majority of the approximate quadrant. That is, the majority of the periphery of the first approximate quadrant of each half is concave, and the majority of the periphery of the second approximate quadrant of each half is convex. In an embodiment, the radius of the concave edge of the first approximate quadrant is the same as the radius of the convex edge of the second approximate quadrant for each half.

The applicator 200 has four turning points 206, 214, 222, 230 or local maximums that approximately define the corners of a square. That is, the applicator 200 can almost be arranged into an approximate square where each of the turning points approximately touches a side of the square. The applicator 200 only approximates a square, because one side of the piece of material can be slightly longer than the other.

Figure 11:
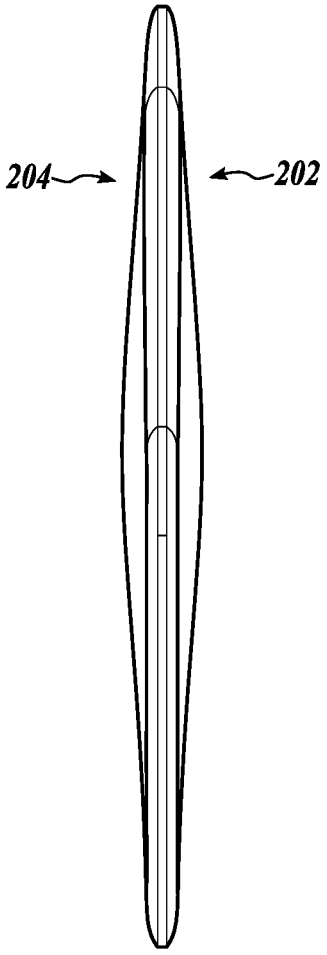
FIG. 11 is a left view of the applicator of FIG. 8, the right view being a mirror image thereof.

FIGS. 10 and 11 show the surface contours of the major surfaces 202 and 204 along the y-axis direction of applicator 200.

FIG. 10 is the zy-plane of symmetry viewed from the x-axis, i.e., the cross-sectional view of the applicator 200 cut along the zy-plane crossing turning points 206 and 222. A second plane of symmetry, the yx-plane bisects the applicator 200 down the thickness into two similar halves, one including the entirety of major surface 202 and the second including the entirety of major surface 204. It can be seen that the first and second major surfaces 202 and 204 are mirror images of each other. Referring to FIG. 10, the thickest part of the applicator 200 approximately coincides with a line crossing the periphery at the turning points 214 and 230 (FIG. 9). The line that crosses the periphery at the opposite turning points 214 and 230 divides the applicator 200 into two asymmetrical halves. From FIG. 9, one asymmetrical half includes both approximate quadrants of the periphery having majority concave sections. The other asymmetrical half includes both approximate quadrants of the periphery having majority convex sections. In an embodiment, the centroid (used herein to quickly denote the z-direction maximum, which may not coincide with center of mass or gravity) lies on such line. However, the centroid and line are offset from the true middle distance between turning points 206 and 222, and are placed more toward the turning point 212 than turning point 206. This location balances the applicator for the user and keeps the thumb and forefinger away from the eye area. The applicator 200 when viewed on edge defines a thickness of material that is greatest at the centroid (z-axis maximum 264) and the thickness decreases toward the periphery in all directions from the centroid. Each major surface 202 and 204 at the thickest part has a dome or convex surface section 264 of radius 266.

From FIG. 10, it can be seen that while the thickness at the edge is the same around the entire periphery, the asymmetrical half in which the convex sections 210 and 234 lie has a lesser rate of decrease in the thickness in the y-axis direction from the center 264 to the edge as compared to the greater rate of decrease in the thickness in the y-axis direction from the center 264 in the asymmetrical half in which the concave sections 218 and 226 lie.

Referring to FIG. 10, from the convex section 264 of radius 266 of major surface 204 and moving in the y-axis direction away from the convex section 264 toward the edge 254, the surface is generally planar to just before the edge 254 which then transitions to a small convex radius and converges generally to a point edge 254. Moving in the opposite direction in the y-axis direction away from convex section 264 toward the edge 256, the surface is generally planer or has a concave section of very large radius which then transitions to a small convex radius and converges generally to a point edge 256 (or straight). The major surface 202 is similar to major surface 204 in the y-axis direction as just described.

Figure 12:
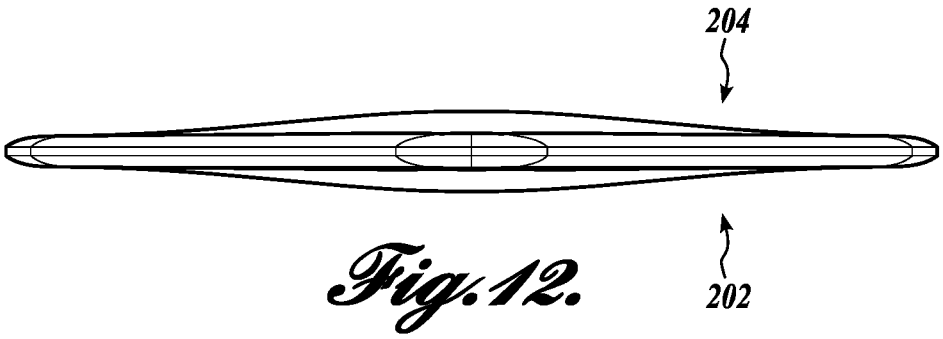
FIG. 12 is a top view of the applicator of FIG. 8.
Figure 13:
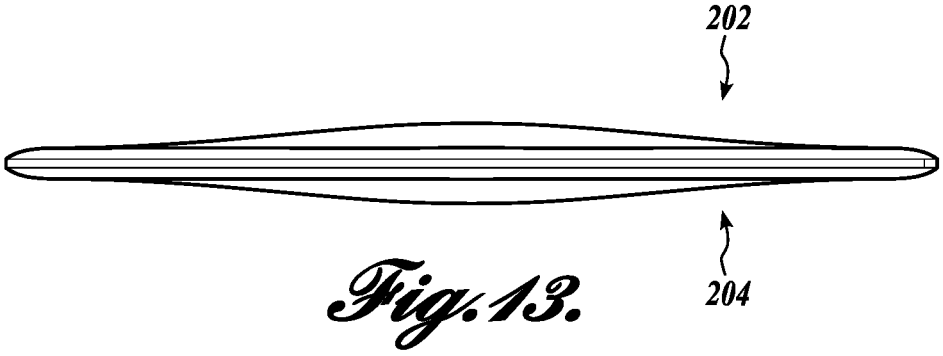
FIG. 13 is a bottom view of the applicator of FIG. 8.
Figure 14:
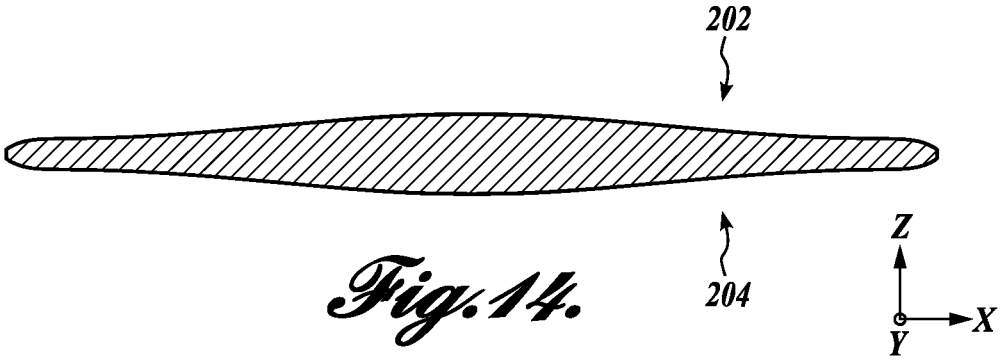
FIG. 14 is a cross-sectional view of the applicator of FIG. 8.

FIGS. 12, 13, and 14 show the surface contours of the major surfaces 202 and 204 along the x-axis direction. FIGS. 12, 13, and 14 show the applicator 200 along the y-axis direction from the top, bottom and cross sections. The general shape of major surface 204 in the x-axis direction is a gradually decreasing thickness when extending outward from the true center in either x-axis direction to the periphery. Thus, the maximum of the dome or convex surface 264 does not lie in the true center of the applicator 200 in the y-axis direction, but does lie in the true center of the applicator 200 in the x-axis direction.

FIG. 14 is the zx-plane viewed from the y-axis, i.e., the cross-sectional view of the applicator 200 cut along the zx-plane crossing turning points 214 and 230. From FIG. 14, the applicator can be bisected along the yx-plane of symmetry into the two major surfaces 102 and 104. This shows that the major surfaces 202 and 204 are mirror images along the x-axis direction as along the y-axis direction as described in FIG. 3.

Referring to FIG. 14, along the x-axis, the convex surface sections of both major surfaces 202, 204 has its maximum at the center of the applicator 200. Along the x-axis direction when moving away from the center in both directions, the convex surface section 264 of both major surfaces 202, 204 transitions into a generally flat surface section or a concave surface sections of very large radius, which then become convex and end in a point edge at the periphery.

Embodiments of the applicator have a strength and form giving it a dynamic ability to apply topical formulas to key parts of the face/head/neck area to cover natural signs of aging (wrinkles and imperfections).

Embodiments of the applicator have an edge and mechanical flexibility (buttressed cross-section and specific durometer) that is ideal to cover the skin on the face with a thin and (critically) even coating of formula.

Embodiments of the applicator edge work flawlessly and intuitively on the first pass of the applicator on the face since some topical formulas begin to set/dry immediately, and multiple passes corrupt the effect.

Embodiments of the applicator have a surface with a slight texture (resembling a faint matte texture)—this is intended to provide a precise and subtle amount of adhesion to the formula as it is distributed across the skin.

Some embodiments of the applicator are symmetrical from side to side to allow the user to intuitively use the applicator with either hand on the face without confusion as to orientation.

Some embodiments of the applicator are designed to feel balanced, easy to use, and can be turned/articulated by the user quickly and effectively to address different areas on the skin.

In an embodiment, an applicator (100, 200) of topical formulas comprises a monolithic piece of material having two equally sized major surfaces (104, 102, 204, 202) separated by a thickness of the material, wherein each major surface has a convex surface section (164, 264) at a maximum that transitions to concave surfaces (162, 166) toward the periphery (168) or diminishes toward the periphery (254), and the piece of material has a perimeter shape defined by the following: a first plane of symmetry bisecting both major surfaces into two similar halves; each half has a turning point at a maximum (114, 130, 214, 230) through which a second plane further divides each half into two approximate quadrants; a first approximate quadrant of each half has a concave periphery (110, 134, 210, 234); and a second approximate quadrant of each half has a convex periphery (118, 126, 218, 226).

In an embodiment, the piece of material is 100% by weight thermoplastic urethane and unavoidable impurities.

In an embodiment, a shape in a thickness direction at an entire edge (168) of the periphery from one major surface to the other is approximately parabolic.

In an embodiment, a shape in a thickness direction at an entire edge (254) of the periphery from one major surface to the other is approximately a point.

In an embodiment, the piece of material has a durometer of 55 Shore A to 80 Shore A.

In an embodiment, a majority of the periphery (110, 134, 210, 234) of the first approximate quadrant of each half is concave.

In an embodiment, a majority of the periphery (118, 126, 218, 226) of the second approximate quadrant of each half is convex.

In an embodiment, the concave and the convex periphery have a similar radius (140, 144, 148, 152, 240, 244, 248, 252).

In an embodiment, the concave edge and the convex periphery have a dissimilar radius (140, 144, 148, 152, 240, 244, 248, 252).

In an embodiment, the thickness of the piece of material decreases from a convex section (164, 264) to the periphery (168, 254).

In an embodiment, when the applicator is arranged in a three-axis coordinate system, wherein the applicator is bisected in two axes into mirror images.

In an embodiment, when the applicator is arranged in a three-axis coordinate system, the applicator has two opposite convex turning points (106, 122, 114, 130, 206, 222, 214, 230) in two axes.

In an embodiment, a radius (138, 238) of a convex turning point (106, 206) is larger than a radius (146, 246) of the opposite convex turning point (122, 222) in a first axis.

In an embodiment, a radius (142, 242) of a convex turning point (114, 214) is the same as a radius (150, 250) of the opposite convex turning point (130, 230) in a second axis.

In an embodiment, the major surfaces are arranged with a length and width in the first and second axes.

In an embodiment, the thickness is in the third axis.

In an embodiment, a maximum (164, 264) in a third axis is placed more toward the convex turning point (122, 222) having the larger radius (146, 246) compared to the opposite convex turning point (106, 206) in the first axis.

In an embodiment, the maximum (164, 264) in the third axis is placed in the center between the convex turning point (114, 214) and the opposite convex turning point (130, 230) having the same radius in the second axis.

In an embodiment, the maximum in the third axis includes a convex surface section (164, 264) in the major surfaces.

In an embodiment, a combination comprises an applicator and a formula configured for topical application on the skin, wherein the applicator (100, 200) is a monolithic piece of material having two equally sized major surfaces (104, 102, 204, 202) separated by a thickness of the material, wherein each major surface has a convex surface section (164, 264) at a maximum that transitions to concave surfaces (162, 166) toward the periphery (168) or diminishes toward the periphery (254), and the piece of material has a perimeter shape defined by the following: a first plane of symmetry bisecting both major surfaces into two similar halves; each half has a turning point at a maximum (114, 130, 214, 230) through which a second plane further divides each half into two approximate quadrants; a first approximate quadrant of each half has a concave periphery (110, 134, 210, 234); and a second approximate quadrant of each half has a convex periphery (118, 126, 218, 226).

In an embodiment, the ornamental design for an applicator, as shown and described, is claimed.

EXAMPLES

In one embodiment, the applicator 100 of FIGS. 1-7 has the following dimensions:

R at 138 is 2.5 mm
R at 140 is 50 mm
R at 142 is 8 mm
R at 144 is 50 mm
R at 146 is 13 mm
R at 148 is 50 mm
R at 150 is 8 mm
R at 152 50 mm
R at 164 is 40 mm
R at 156 is 200 mm
R at 160 is 100 mm
L from 114 to 130 is 55 mm
L from 122 to 106 is 57 mm
L from 122 to 130 is 27 mm
Thickness at 154 is 2 mm
Thickness at 164 is 6 mm In one embodiment, the applicator 200 of FIGS. 8-14 has the following dimensions:

R at 238 is 3 mm
R at 240 is 48 mm

R at 242 is 5 mm
R at 244 is 48 mm
R at 246 is 12 mm
R at 248 is 48 mm
R at 250 is 5 mm
R at 252 is 48 mm
R at 266 is 73 mm
L from 214 to 230 is 52.5 mm
L from 222 to 206 is 53 mm
Thickness at 254 is 0.5 mm
Thickness at 264 is 4.5 mm While illustrative embodiments have been illustrated and described, it will be appreciated that various changes can be made therein without departing from the spirit and scope of the invention.

The embodiments of the invention in which an exclusive property or privilege is claimed are defined as follows:

1. An applicator of topical formulas, comprising:

a monolithic piece of material having two equally sized major surfaces separated by a thickness of the material, wherein each major surface has a convex surface section and a concave surface section, wherein the convex surface section is at a maximum that transitions to the concave surface section toward the periphery or diminishes toward the periphery, wherein the major surfaces have matte surface texturing to provide an adhesive surface for the formulas, and the piece of material has an entire periphery edge defined by the following:

a first plane of symmetry bisecting both major surfaces into two similar halves;

each half has a turning point at a maximum through which a second plane further divides each half into two approximate quadrants;

a first approximate quadrant of each half has a concave periphery; and a second approximate quadrant of each half has a convex periphery, wherein the entire periphery edge of the applicator is composed of the concave periphery and convex periphery of each quadrant, each major surface has a maximum that is approximately at the intersection of two opposite turning points, each major surface diminishes from the maximum at a greater rate to the convex periphery as compared to the concave periphery, and wherein the maximum of each major surface is placed more toward a convex turning point having a larger radius compared to the opposite convex turning point.

2. The applicator of claim 1, wherein the piece of material is 100% by weight thermoplastic urethane and unavoidable impurities.

3. The applicator of claim 1, wherein a shape in a thickness direction at an entire edge of the periphery from one major surface to the other is approximately parabolic.

4. The applicator of claim 1, wherein a shape in a thickness direction at an entire edge of the periphery from one major surface to the other is approximately a point.

5. The applicator of claim 1, wherein the piece of material has a durometer of 55 Shore A to 80 Shore A.

6. The applicator of claim 1, wherein a majority of the periphery of the first approximate quadrant of each half is concave.

7. The applicator of claim 1, wherein a majority of the periphery of the second approximate quadrant of each half is convex.

8. The applicator of claim 1, wherein the concave and the convex periphery have a similar radius.

9. The applicator of claim 1, wherein the concave edge and the convex periphery have a dissimilar radius.

10. The applicator of claim 1, wherein the thickness of the piece of material decreases from a convex section to the periphery.

11. The applicator of claim 1, wherein, when the applicator is arranged in a three-axis coordinate system, the applicator is bisected in two axes into mirror images.

12. The applicator of claim 1, wherein, when the applicator is arranged in a three-axis coordinate system, the applicator has two opposite convex turning points in two axes.

13. The applicator of claim 12, wherein a radius of a convex turning point is larger than a radius of the opposite convex turning point in a first axis.

14. The applicator of claim 13, wherein a radius of a convex turning point is the same as a radius of the opposite convex turning point in a second axis.

15. The applicator of claim 14, wherein the major surfaces are arranged with a length and width in the first and second axes.

16. The applicator of claim 15, wherein the thickness is in the third axis.

17. The applicator of claim 15, wherein a maximum in a third axis is placed more toward the convex turning point having the larger radius compared to the opposite convex turning point in the first axis.

18. The applicator of claim 17, wherein the maximum in the third axis is placed in the center between the convex turning point and the opposite convex turning point having the same radius in the second axis.

19. The applicator of claim 18, wherein the maximum in the third axis includes a convex surface section in the major surfaces.

20. A combination, comprising:

the applicator of claim 1; and a formula configured for topical application on the skin.

* * * * *